US005906528A

United States Patent [19]

Ostendorff et al.

[11] Patent Number: 5,906,528

[45] Date of Patent: May 25, 1999

[54] AIR-DRIVEN EXPLODING TOY VEHICLE

[75] Inventors: Eric Ostendorff, Torrance; Phedon Tsiknopoulos, Hawthorne, both of Calif.

[73] Assignee: Mattel, Inc., El Segundo, Calif.

[21] Appl. No.: 09/133,892

[22] Filed: Aug. 14, 1998

[51] Int. Cl.[6] ..... A63H 17/02

[52] U.S. Cl. ..... 446/6; 446/176; 446/435; 446/441; 446/471

[58] Field of Search ..... 446/4, 5, 6, 176, 446/180, 189, 197, 198, 199, 308, 435, 441, 471

[56] References Cited

U.S. PATENT DOCUMENTS

| | | | |
|---|---|---|---|
| 2,757,482 | 8/1956 | Brown et al. . | |
| 3,000,137 | 9/1961 | Vine . | |
| 3,668,804 | 6/1972 | Winston | 446/6 |
| 4,171,806 | 10/1979 | Goldfarb et al. . | |
| 4,240,224 | 12/1980 | Katzman et al. | 446/197 |
| 4,259,805 | 4/1981 | Hornsby, Jr. . | |
| 4,571,197 | 2/1986 | Kulesza et al. . | |
| 4,911,669 | 3/1990 | Parker . | |
| 4,936,809 | 6/1990 | Auer et al. | 446/184 |
| 4,943,256 | 7/1990 | Symons . | |
| 5,131,880 | 7/1992 | Nesbit et al. | 446/180 |
| 5,295,890 | 3/1994 | Myers | 446/176 |
| 5,380,231 | 1/1995 | Brovelli | 446/6 |
| 5,512,002 | 4/1996 | Lieberman | 446/471 |

*Primary Examiner*—Robert A. Hafer
*Assistant Examiner*—Jeffrey D. Carlson
*Attorney, Agent, or Firm*—Roy A. Ekstrand

[57] ABSTRACT

A toy vehicle includes an inner body having a plurality of apertures formed therein and having an interior cavity. A plurality of body panels are formed to be received upon the inner body to form an outer body and are releasibly secured thereto in a snap-fit attachment. A pressure tank and pump are supported within the inner body to provide a reservoir of compressed air secured by a releasible trigger latch. The trigger latch is operated in response to impact against the vehicle front whereupon the latch is released and the pressurized air within the pressure tank rapidly pressurizes the inner body driving the body panels from it in all directions and creating a loud bang.

11 Claims, 2 Drawing Sheets

AIR-DRIVEN EXPLODING TOY VEHICLE

FIELD OF THE INVENTION

This invention relates generally to toy vehicles and particularly to those having an impact responsive action such as simulated explosion or the like.

BACKGROUND OF THE INVENTION

Toy vehicles are well known in the art and have been produced in a virtually endless variety. Thus, practitioners in the toy arts have provided toy vehicles which are unpowered and which comprise freely rolling toys. Other toy vehicles are self-powered relying upon internal battery and electric motor power mechanisms or other devices such as spring-driven wind-up mechanisms to propel the toy vehicle. Still other toy vehicles have been provided which employ different types of crash features, most of which are responsive to impact with an object or another toy vehicle. These crash features have included toy vehicles which are formed of flexible materials and which deform upon impact. Also familiar in the art are toy vehicles which upon impact with an object undergo an abrupt flip or roll action. Still other toy vehicles having crash features utilize some type of simulation of explosion upon impact. Typically, the toy vehicles so equipped utilize a plurality of outer body parts which are coupled to spring-loaded mechanisms triggered in response to an impact.

U.S. Pat. No. 2,757,482 issued to Brown, et al. sets forth a SELECTIVELY SELF-WRECKING TOY VEHICLE having a chassis supporting rolling wheels and a plurality of body components resting thereon. A plurality of impact trigger spring-loaded mechanisms eject the body parts upon a triggering impact.

U.S. Pat. No. 4,911,669 issued to Parker sets forth a TOY SIMULATED EXPLODING VEHICLE having a battery-powered drive mechanism together with an impact responsive pivotal lever. A portion of the frontal body of the toy vehicle is removable and is impacted and sent flying by the pivotable lever within the interior of the car.

U.S. Pat. No. 4,571,197 issued to Kulesza, et al. sets forth an IMPACT RESPONSIVE TOY VEHICLE having front and rear vehicle portions joined by a spring-loaded release. The spring-loaded release is triggered by impacts on the front of the car and is operative to allow the car to separate into two pieces following impact.

U.S. Pat. No. 5,295,890 issued to Myers sets forth a REMOTELY-CONTROLLED TOY VEHICLE WITH WATER EJECTION CAPABILITIES having a tractor-like vehicle supporting an internal water reservoir and a pressurizing pump. A nozzle is coupled to the pressurized reservoir and is directed forwardly and upwardly to produce a correspondingly directed stream of water.

U.S. Pat. No. 5,380,231 issued to Brovelli sets forth a TOY THAT DISASSEMBLES UPON AN IMPACT having a toy vehicle body supporting a plurality of removable components. A plurality of spring mechanisms are operative in combination with a plurality of latches to captivate the body parts against the chassis in a spring-loaded latch attachment. Upon impact, a latch release member trips each latch whereupon the springs operate to eject the body parts.

U.S. Pat. No. 3,000,137 issued to Vine sets forth a SELF-UPSETTING TOY VEHICLE having a chassis, a body and a plurality of rolling wheels. The front bumper of the toy vehicle is movable in response to impacts and is spring biased toward an extended frontal position. A spring-driven arm is controlled by a latch and supported on the underside of the toy vehicle. In response to an impact, the latch is released and the lever strikes downwardly flipping the toy vehicle over.

U.S. Pat. No. 4,943,256 issued to Symons sets forth an AMUSEMENT DEVICE PROPELLED BY AN ECCENTRIC APPARATUS which responds to remotely transmitted communication.

While the foregoing described prior art devices have improved the art and in some instances enjoyed commercial success, they have nonetheless fallen short of providing the degree of excitement and realism which one would expect in a so-called exploding toy vehicle. Accordingly, there remains a continuing need in the art for evermore realistic, entertaining and exciting explosion simulating toy vehicles.

SUMMARY OF THE INVENTION

Accordingly, it is a general object of the present invention to provide an improved toy vehicle. It is a more particular object of the present invention to provide an improved toy vehicle having a realistic and exciting crash and explosion action feature.

In accordance with the present invention, there is provided an explosion simulating toy vehicle comprising: an inner body having a plurality of openings therein; a plurality of outer body panels receivable upon the inner body to form an outer body; a pressure tank having a neck edge and means for compressing air within the tank; and a latch sealing the edge and a trigger for releasing the latch, the trigger releasing the latch allowing compressed air to exit the pressure tank, produce a loud noise and force the outer body panels from the inner body.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
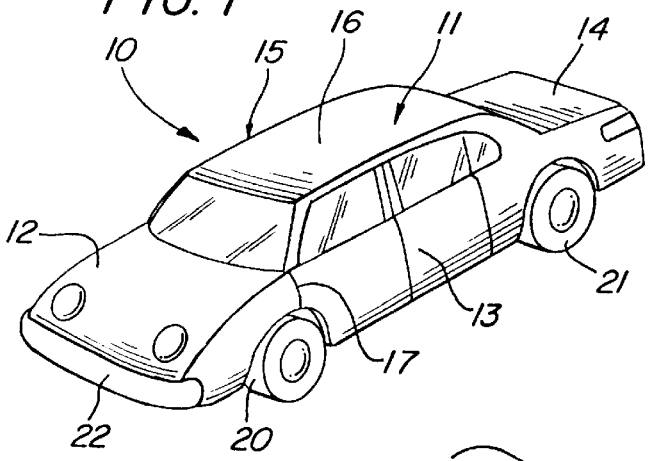
FIG. 1 sets forth a perspective view of a toy vehicle constructed in accordance with the present invention.

FIG. 1 sets forth a perspective view of a toy vehicle constructed in accordance with the present invention and generally referenced by numeral 10. Toy vehicle 10 includes an outer body 11 supported by a plurality of rolling wheels including wheels 20 and 21. In the anticipated fabrication of toy vehicle 10, a corresponding pair of wheels (not shown) are supported on the hidden side of toy vehicle 10. The attachment and rolling mechanism of the wheels upon toy vehicle 10 are constructed in accordance with conventional fabrication techniques. For example, a front and rear axle may extend between wheels 20 and 21 respectively to a correspondingly placed pair of wheels on the opposite side of toy vehicle 10.

In accordance with the present invention, outer body 11 is preferably fabricated of a soft flexible material such as plastic or foam plastic and is separated into a plurality of body panels. Thus, outer body 11 includes a hood panel 12, side panels 13 and 15, a roof panel 16 and a trunk panel 14. Panels 12 through 16 are secured to a supporting under body (seen in FIG. 2) and meet along various seams such as seam 17 to form outer body 11 when assembled as shown in FIG. 1.

Figure 2:
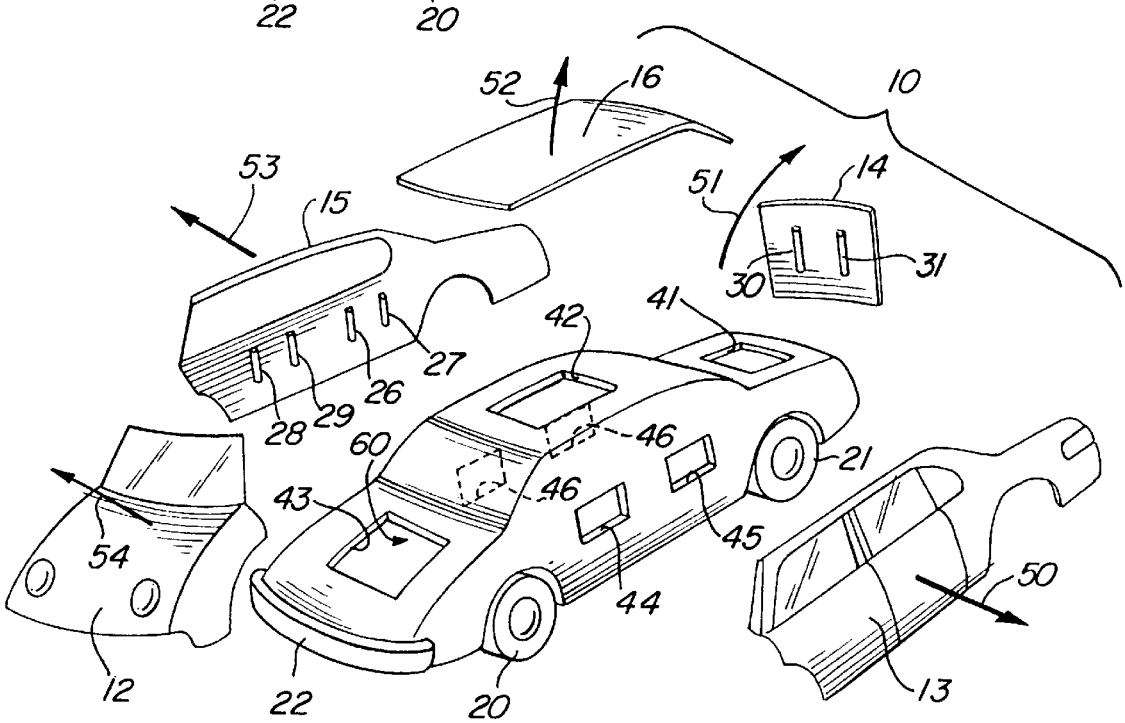
FIG. 2 sets forth a perspective view of the present invention toy vehicle during the explosion simulation.

In accordance with an important aspect of the present invention, panels 12 through 16 are removably supported upon toy vehicle 10 using a plurality of apertures formed in inner body 40 shown in FIG. 2. Also in further accordance with the present invention and as is described below in greater detail in FIGS. 4 and 5, toy vehicle 10 includes a novel explosion simulation device which includes a pressure vessel and a trigger release therefor which is operative in response to impacts against bumper 22. Thus, toy vehicle 10 assumes a substantially normal appearance when fully assembled as shown in FIG. 1.

FIG. 2 sets forth a perspective view of toy vehicle 10 following the triggering of the explosion simulation device referred to above, Toy vehicle 10 includes an inner body 40 supporting wheels 20 and 21 and defining a plurality of apertures communicating with interior cavity 60 of inner body 40. In the preferred fabrication of the present invention, interior cavity 60 of inner body 40 forms a plenum which is generally sealed or at least substantially air tight and which but for apertures 41 through 47 formed therein forms a substantially complete enclosure.

Thus, inner body 40 defines a trunk aperture 41, a roof aperture 42, a hood aperture 43, a pair of side apertures 44 and 45 and a second pair of side apertures 46 and 47. As mentioned above, outer body 11 (seen in FIG. 1) comprises a plurality of panels including hood panel 12, side panels 13 and 15, a trunk panel 14 and a roof panel 16. The attachment apparatus used to secure panels 12 through 16 to inner body 40 is set forth in greater detail in FIG. 3. However, suffice it to note here that body panels 12 through 16 are secured in a removable attachment to inner body 40 so as to close and overlie apertures 41 through 47 and present a complete toy vehicle as shown in FIG. 1. The attachment mechanism shown in FIG. 3 in greater detail utilizes the cooperation of a pair of spaced apart ribs such as ribs 30 and 31 formed on the inner surface of trunk panel 14 to snap-fit within an underlying aperture of inner body 40 such as aperture 41. The snap-in attachment of the various body panels has as its primary consideration the use of a snap attachment which will respond to pressurizing of interior cavity 60 by initially holding and then releasing the body panel in response to continued increases in pressure. Thus, for example, trunk panel 14 supports ribs 30 and 31 which are received within aperture 40 and 41 in the manner shown in FIG. 3, As a result, trunk panel 14 is secured to inner body 40 to present the panel in its attached position such as that shown in FIG. 1. Correspondingly, side panel 15 supports two pairs of attachment ribs 26 and 27 together with 28 and 29 which are received within apertures 46 and 47 respectively in the side portion of inner body 40 to secure side panel 15 thereto. While not shown in FIG. 2, it will be understood that hood panel 12, side panel 13 and roof panel 16 define similar snap-fit attachment ribs which cooperate with aperture 43, apertures 44 and 45, and aperture 42 respectively.

The operation of the explosion simulating apparatus by which body panels 12 through 16 are propelled from inner body 40 is set forth below in greater detail in FIGS. 4 and 5. However, suffice it to note here that the operative mechanism includes a pressurizable vessel having a pump for pressurizing the vessel and a trigger releasible cap for maintaining pressure within the vessel until released in response to a trigger. The trigger is operated in response to impact to front bumper 22. However, it will be apparent to those skilled in the art that other trigger mechanisms and locations may be supported upon toy vehicle 10.

In the position shown in FIG. 2, the air pressure within the vessel has been released causing a sudden pressurization of interior cavity 60. Thereafter, in the manner shown in FIG. 3 in greater detail, the body panels are able to resist this increased pressure for a very short time and thereafter are pushed from their seated positions to fly in all directions as indicated in the drawing of FIG. 2. Once the child user has enjoyed the explosive simulation feature, the user replaces body panels 12 through 16 to form the vehicle shown in FIG. 1 and pumps the pressure vessel pump to repressurize the vessel and prepare for the next impact. In a typical play pattern, the child user will send toy vehicle 10 across a play surface with the object of colliding with an object and triggering the explosion. In other play patterns, a plurality of such vehicles may be operated to simulate other crashes or a so-called "demolition derby" type activity. In the illustrative toy vehicle shown in FIGS. 1 and 2, the toy vehicle may be radio-controlled such that the user avoids the need to roll the vehicle across a floor surface but rather is able to remotely pilot the vehicle and thereby enhance the excitement of the vehicle's explosion simulation mechanism. Similarly, toy vehicle 10 may be used in a track set environment in which various intersections or the like are provided and in which the potential exists for colliding with other toy vehicles.

Figure 3:
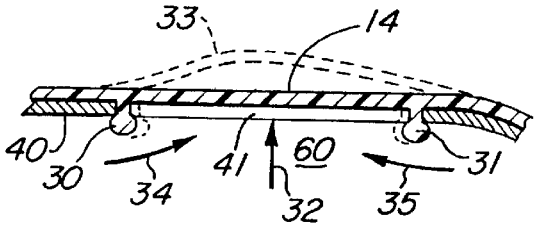
FIG. 3 sets forth a partial section view of the releasible attachment of the outer body to the inner body of the present invention toy vehicle.

FIG. 3 sets forth a partial section view of trunk 14 secured to inner body 40. It will be understood by those skilled in the art that the section view of FIG. 13 showing trunk panel 14 secured to inner body 40 is illustrative of the remaining body panel attachments and the separation and expansion thereof which result from the sudden pressurization described below.

More specifically, inner body 40 defines a trunk aperture 41 positioned as shown in FIG. 2. A trunk panel 14 preferably fabricated of a flexible somewhat resilient material such as foam plastic, rubber or other plastics defines a pair of ribs 30 and 31 which are received within aperture 41 and which tend to engage the sides thereof. With trunk panel 14 secured to the trunk portion of inner body 40, the trunk panel overlies and substantially closes trunk aperture 41.

In response to the sudden pressurization of interior cavity 60 of inner body 40, a substantial force is applied to trunk panel 14 in the direction indicated by arrow 32. This force is equal to the pressure multiplied by the area of exposed trunk panel 14 defined by aperture 41. In the preferred fabrication of ribs 30 and 31, some mechanism is provided to allow trunk panel 14 to initially resist the force of pressurized air within interior cavity 60 until the pressure has built to exert a very substantial force on trunk panel 14. Because of the flexible resilient material of trunk panel 14, the force in the direction indicated by arrow 32 tends to flex or bulge panel 14 outwardly toward the dashed-line outline 33 shown in FIG. 3. The outward bulge of panel 14 draws ribs 30 and 31 inwardly and tends to pull them from their seated positions as indicated by the pivotal arrows 34 and 35. Once this situation occurs, panel 14 is abruptly launched from inner body 40. This abrupt launch is achieved by the structures of ribs 30 and 31 and their function of initially gripping and then suddenly releasing as pressure builds. This has been found to be a highly desirable characteristic in that it creates a more realistic explosion simulation.

Once again it should be understood that each of body panels 12 through 16 utilize corresponding pair of ribs in the manner shown for ribs 30 and 31 within aperture 41 to secure their respective body panels to inner body 40. Accordingly, the descriptions in FIG. 3 should be understood to apply equally well to side panel 15 and its use of ribs 26 through 29 as well as body panels 12, 13 and 16.

Figure 4:
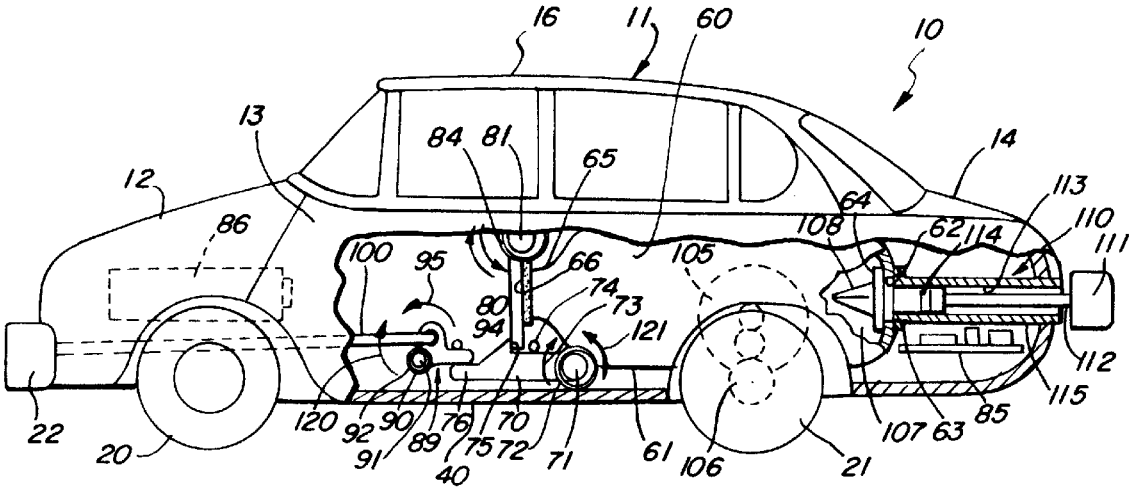
FIG. 4 sets forth a partially sectioned side view of the present invention toy vehicle.

FIG. 4 sets forth a partially sectioned side view of toy vehicle 10 which illustrates the explosion producing mechanism supported within interior cavity 60 of vehicle 10. Once again, the general operation of this explosion producing mechanism involves the use of a pressurizable vessel having a triggered release of pressurized air and having a bumper operated impact responsive trigger mechanism for releasing the pressurized air. This pressurized air exerting force outwardly through the various apertures formed in inner body 40 (seen in FIG. 2) separates the body panels and simulates an explosion.

More specifically, toy vehicle 10 includes an outer body 11 having a hood panel 12, a side panel 13, a trunk panel 14 and a roof panel 16. As is seen in FIG. 2, toy vehicle 10 further includes a side panel 15 not observable in FIG. 4 due to the side elevation view. Panels 12 through 16 are received upon inner body 40 in the above-described manner.

In accordance with the present invention, inner body 40 accommodates and supports an elongated pressure tank 61 having a neck 65 terminating in an edge 66. Pressure tank 61 further defines an interior 107 and an aperture 62 in the rear portion thereof. A pair of resilient seals 63 and 64 are positioned on the outside and inside of pressure tank 61 to seal a generally cylindrical pump barrel 115 extending through aperture 62. Seal 64 further supports a check valve 108 which is operative to open in response to pressure from within pump barrel 115 and is operative to close in the absence of such pressure. Pump 110 utilizes pump barrel 115 to pressurize interior 107 of pressure tank 61. Pump 110 includes in addition to pump barrel 115 and seals 63 and 64 a piston movable within a cylinder bore 113 formed in pump barrel 115. A piston rod 112 is coupled between piston 114 and an external pump handle 111.

A generally planar cap plate 80 is pivotally secured within interior cavity 60 by a pivot 81. A spring 84 fabricated in accordance with conventional coil spring techniques is coupled to pivot 81 and cap plate 80 to exert a spring force upon cap plate 80 which urges it in the direction indicated by arrow 83. As is better seen in FIG. 5, cap plate 80 is positioned against edge 66 of pressure tank 61 and includes a resilient seal layer 87 forced against edge 66.

A latch 70 includes a pivot 71 pivotally supporting one edge of latch 70 and having a conventional coil spring 72 operatively coupled thereto. Spring 72 provides a spring force urging latch 70 to pivot about pivot 71 in the direction indicated by arrow 73. A limit post 74 is positioned proximate to latch 71 to limit the travel of latch 71 in response to the force of spring 72. Latch 70 further includes an extending tab 76 and an edge 75. In the position shown in FIG. 4, edge 75 engages and grips the lower portion of cap plate 80. In this position, pressure tank 61 is effectively sealed and the latching characteristic of latch 70 maintains a secure resistance upon cap plate 80 which prevents the cap plate from pivoting away from edge 66.

Toy vehicle 10 further includes a trigger 89 having a pivot 90 and a tab 93. A coil spring 92 is operatively coupled between pivot 91 and trigger 89 to urge trigger 89 in the direction indicated by arrow 95. Tab 93 extends to tab 76 of latch 70 and is positioned in light contact therewith or proximate thereto. A trigger rod 100 is coupled to trigger 89 in an offset position and extends through suitable apertures formed in inner body 40 such as passage 37 shown in FIG. 5. The outer end of trigger rod 100 is secured to bumper 22.

Toy vehicle 10 further includes a remote control circuit 85 operative to control an electric motor 105 which is coupled to wheel 21 by a plurality of gears including gear 106. A battery 86 is supported within inner body 40 and is operatively coupled to motor 105 and remote control circuit 85 in accordance with conventional electrical wire connections (not shown).

In operation, the user initially operates pump 110 by reciprocal motion of pump handle 111 to drive piston 114 forwardly within pump barrel 115 and force pressurized air through check valve 108. The user then withdraws pump handle 111 to perform another compression stroke and so on. The pressurizing of interior 107 of pressure tank 61 continues as check valve 108 prevents pressurized air from returning to pump 110 and as the latched closure of pressure tank 61 provided by cap plate 80 maintains the integrity of pressure tank 61. After repeated pumping of pump 110, a desired pressure is achieved within interior 107 of pressure tank 61.

Once pressure tank 61 is pressurized and as a result stores a captive volume of pressurized air, the user may then operate toy vehicle 10 in accordance with its otherwise normal operative characteristics. Thus, for purposes of illustration, FIG. 4 shows toy vehicle 10 having a self-powered battery and electric motor drive combination together with a remote control circuit for controlling vehicle operation. However, it will be apparent to those skilled in the art that the use of a remote-controlled circuit and/or a self-powered battery drive circuit within the present invention toy vehicle is not essential to the operation of the inventive vehicle. On the contrary, toy vehicle 10 may be either powered or unpowered as the user prefers.

In accordance with the operation of the present invention, an impact by toy vehicle 10 against bumper 22 such as collision with another object causes trigger rod 100 to overcome the force of spring 92 and thereby pivot trigger 89 about pivot 90 in the direction indicated by arrow 120. As trigger 89 pivots, tab 93 develops a force against tab 76 urging latch 70 against the force of spring 72 and toward pivotal motion in the direction indicated by arrow 121. As latch 70 pivots away from the end portion of cap plate 80, cap plate 80 is released from its engagement with edge 75. Upon the release of edge 75, pressure within interior cavity 60 of pressure tank 61 rapidly and suddenly overcomes the force of spring 82 causing cap plate 80 to rapidly and abruptly pivot about pivot 81 in the direction indicated by arrow 122. With cap plate 80 pivoted away from edge 66 and the pressure seal of pressure tank 61 abruptly released, an explosive sound is produced by air rushing outwardly from interior cavity 60. In addition, the pressurized air escaping from the now open pressure tank rapidly fills inner body 40 with pressurized air producing the explosion simulation forces against the various body panels of outer body 11 (shown in FIG. 2). At this point, the various body panels are thrust away from inner body 40 and an explosion simulation is complete. In accordance with an important advantage of the present invention, the use of pressurized air and a trigger released pressure tank to provide the motive force of body panel dispersion is accompanied by a highly desirable sound simulating the bang of an explosion. Following the occurrence of a simulated explosion, the pressure within pressure tank 61 is exhausted and the spring force of spring 84 urges cap plate 80 in the direction indicated by arrow 83. By means set forth below in greater detail, the force of spring 84 resets the position of cap 80 in its sealing position and also, by means set forth below in greater detail, the movement of cap 80 resets latch 70 in the locked position. Once again, the user operates pumps 110 in a reciprocal fashion to build air pressure within interior 107 of pressure tank 61.

Figure 5:
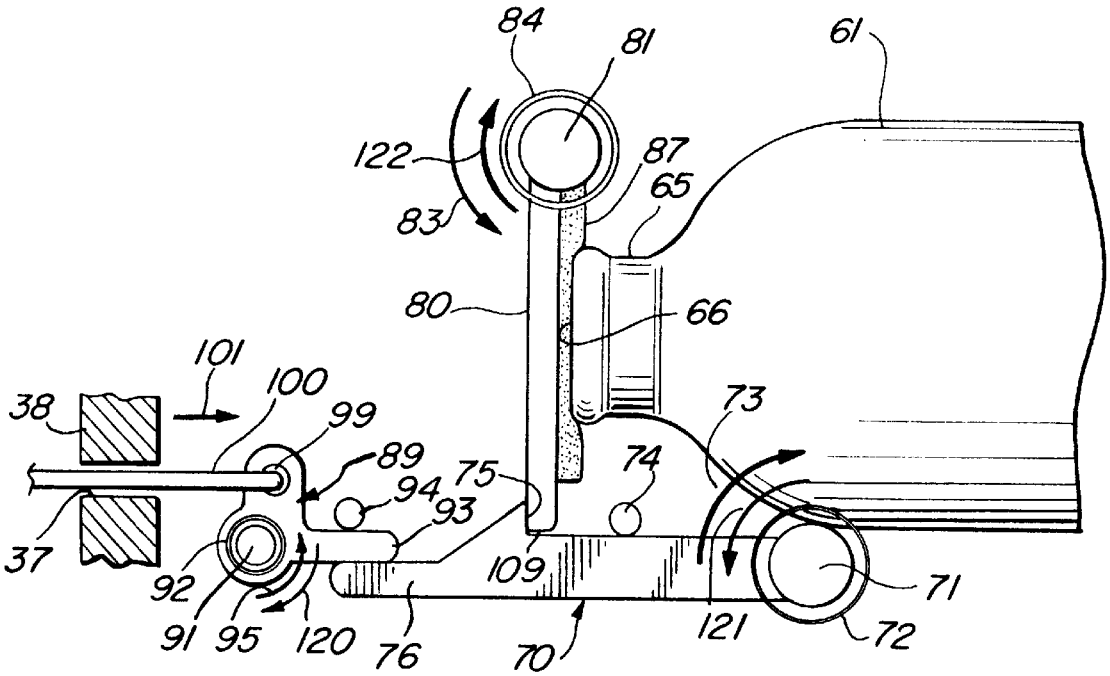
FIG. 5 sets forth a partially sectioned side view of the impact-responsive pressure release apparatus of the present invention toy vehicle.

FIG. 5 sets forth an enlarged partially sectioned view of the explosion simulation triggering apparatus. As described above, toy vehicle 10 includes a pressure tank 61 having a neck 65 forming an edge 66. A pivot 81 supports a cap plate 80 having a resilient seal 87. A spring 84 is coupled to pivot 81 and to cap plate 80 so as to urge cap plate 80 in the direction indicated by arrow 83. The resilient material of resilient seal 87 forms an air-tight closure of edge 66 of pressure tank 61.

A latch 70 is pivotally secured by a pivot 71 and defines an angled surface 96, a gripping edge 75 and an extending tab 76. A post 74 is positioned proximate to latch 70.

A trigger 89 is pivotally supported upon a pivot 91 and includes an extending tab 93. Trigger 89 further includes a spring 92 coupled to pivot 91 and trigger 89 producing a spring force which urges trigger 89 pivotally about pivot 91 in the direction indicated by arrow 95. Post 94 limits the travel of trigger 89 in response to the spring force of spring 92. Tab 93 extends across the end portion of tab 76 of latch 70. An elongated trigger rod 100 passes through a passage 37 formed in an inner body support 38 and defines an end coupling received within aperture 99 of trigger 89.

In the latched position shown in FIG. 5, the combination of latch 70 and edge 75 thereof engaging cap plate 80 together with the force of spring 84 maintains an air-tight pressure resistive closure of neck 65 of pressure tank 61. Also, in the position shown in FIG. 5, trigger rod 100 and trigger 89 are positioned such that no force is coupled between tab 93 and tab 76. Trigger 89 is rested against post 94 in the absence of force from trigger rod 100. In this position, pressure tank 61 is pumped to the desired air pressure in preparation for use. Once pressure tank 61 is properly pressurized, any impact against bumper 22 (seen in FIG. 4) is communicated by trigger rod 100 and moves trigger rod 100 in the direction indicated by arrow 101. The force of trigger rod 100 pivots trigger 89 in the direction indicated by arrow 120 imparting a force to tab 76 which pivots latch 70 in the direction indicated by arrow 121. If the trigger force applied to bumper 22 (seen in FIG. 4) and communicated to trigger 89 by trigger rod 100 is sufficient, tab 93 will move latch 70 a sufficient distance in the direction indicated by arrow 121 to release the grip of edge 75 upon the bottom end of cap plate 80. Without the engagement of latch 70 to restrain the pressure force within pressure tank 61, the force of spring 83 is overcome and cap plate 80 is abruptly driven to pivot in the direction indicated by arrow 122 allowing the pressurized air within tank 61 to explode into the interior of inner body 40 (seen in FIG. 2). This escaping pressurized air immediately pressurizes the inner body producing the above-described explosion simulation.

After the pressurized air has rapidly left pressure tank 61, the force upon cap plate 80 is diminished and spring 84 forces cap plate 80 to pivot again in the direction indicated by arrow 83. As cap plate 80 pivots about pivot 81 in the direction indicated by arrow 83, bottom edge 109 of cap plate 80 is forced against camming surface 96 of latch 70. The angled character of camming surface 96 responds to the force of edge 109 of cap plate 80 by communicating a force against latch 70 which pivots latch 70 in the direction indicated by arrow 121. This pivoting motion continues until end 109 of cap plate 80 passes beyond the inward extent of camming surface 96. As cap plate 80 continues to pivot in the direction indicated by arrow 83, resilient seal 87 is forced against edge 66 of neck 65 causing resilient seal 87 to sealingly deform upon edge 66. Once latch 70 is released from the camming action, spring 72 causes latch 70 to pivot upwardly in the direction indicated by arrow 73. This pivotal movement continues until edge 109 of cap plate 80 contacts latch 70. As a result, latch 70 returns to the position shown in which edge 75 captivatingly engages edge 109. During this operation, the position of latch 70 for proper camming to the reset or latched position is maintained by the limitation of pivotal movement of post 74. Once latch 70 has been reset to the position shown in FIG. 5, pressure tank 61 is again sealed and awaits the next movement of trigger rod 100 to carry forward the above-described pressure release as trigger 89 pivots forcing tab 93 against tab 76.

As a result, the pressure vessel within the present invention toy vehicle may be repeatedly pumped up to pressure, released to simulate explosions, and reset to the pressurizable configuration shown in FIG. 5 with convenience and ease.

What has been shown is a toy vehicle which includes an air-driven explosion simulation having a dramatic sound and dramatic explosion-type action. The toy vehicle utilizes a simple air pressure tank which responds very closely to chemical explosions or other large types of explosions to provide both the sound and the explosive action without the need for expensive spring-driven systems of the type utilized in the prior art. The accompanying sound produced by the abrupt release of pressure within the pressure tank is dramatic and provides a facet not heretofore realized in spring action type toy vehicles.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An explosion simulating toy vehicle comprising:

an inner body having a plurality of openings therein;

a plurality of outer body panels receivable upon said inner body to form an outer body;

a pressure tank having a neck edge and means for compressing air within said tank; and a latch sealing said edge and a trigger for releasing said latch, said trigger releasing said latch allowing compressed air to exit said pressure tank, produce a loud noise and force said outer body panels from said inner body.

2. The explosion simulating toy vehicle set forth in claim 1 wherein said openings define apertures.

3. The explosion simulating toy vehicle set forth in claim 2 wherein each of said outer body panels includes snap-fit attachment means for securing said outer body panel to one of said apertures.

4. The explosion simulating toy vehicle set forth in claim 3 wherein said outer body panels are formed of a flexible material.

5. The explosion simulating toy vehicle set forth in claim 4 wherein said latch includes a pivotally supported cap plate and a movable latch member locking said cap plate against said edge to seal said pressure tank.

6. The explosion simulating toy vehicle set forth in claim 5 wherein said toy vehicle includes a movable front bumper and a trigger rod coupled between said bumper and said trigger responsive to impact against said bumper.

7. The explosion simulating toy vehicle set forth in claim 1 wherein said outer body panels are formed of a flexible material.

8. The explosion simulating toy vehicle set forth in claim 7 wherein said latch includes a pivotally supported cap plate and a movable latch member locking said cap plate against said edge to seal said pressure tank.

9. The explosion simulating toy vehicle set forth in claim 8 wherein said toy vehicle includes a movable front bumper and a trigger rod coupled between said bumper and said trigger responsive to impact against said bumper.

10. The explosion simulating toy vehicle set forth in claim 1 wherein said toy vehicle includes a movable front bumper and a trigger rod coupled between said bumper and said trigger responsive to impact against said bumper.

11. An explosion simulating toy vehicle comprising:

an inner body support having an interior cavity and a plurality of openings therein;

a plurality of body panels releasibly secured to said inner body support to form an outer body;

a pressure tank having a discharge aperture and means for pressurizing said pressure tank;

a releasible seal for sealing said aperture, and a trigger for releasing said seal allowing pressurized pressure tank to explode said body panels from said inner body support.

* * * * *